United States Patent [19]

Klausen

[11] Patent Number: 4,934,872

[45] Date of Patent: Jun. 19, 1990

[54] ARRANGEMENT IN AN OFFSHORE PLATFORM, AND METHOD FOR THE MOUNTING THEREOF

[75] Inventor: Erik Klausen, Hvalstad, Norway

[73] Assignee: Aker Engineering A/S, Oslo, Norway

[21] Appl. No.: 101,747

[22] Filed: Sep. 28, 1987

[30] Foreign Application Priority Data

Sep. 30, 1986 [NO] Norway ..... 863901

[51] Int. Cl.[5] ..... E02B 17/00; B63B 21/50

[52] U.S. Cl. ..... 405/227; 405/195; 405/224

[58] Field of Search ..... 405/224, 202, 195, 227, 405/229; 248/560, 621, 636

[56] References Cited

U.S. PATENT DOCUMENTS

| | | | |
|---|---|---|---|
| 904,585 | 11/1908 | Wenzel | 248/621 |
| 2,717,747 | 9/1955 | Rosenzweig | 248/621 |
| 3,208,228 | 9/1965 | Paulet | 405/224 |
| 3,355,899 | 12/1967 | Koonce et al. | 405/202 |
| 3,611,734 | 10/1971 | Mott | 405/224 X |
| 3,710,580 | 1/1973 | Mott | 405/202 |
| 4,045,968 | 9/1977 | Gerwick | 405/195 |
| 4,137,722 | 2/1979 | Mossiossian et al. | 405/202 |
| 4,195,950 | 4/1980 | Goldman | 405/195 |
| 4,320,993 | 5/1982 | Hunter | 405/224 |
| 4,687,062 | 8/1987 | Beghetto et al. | 405/227 X |
| 4,771,989 | 9/1988 | Smith | 248/621 X |

FOREIGN PATENT DOCUMENTS

| | | | |
|---|---|---|---|
| 965134 | 7/1964 | United Kingdom | 248/621 |

*Primary Examiner*—Dennis L. Taylor

*Attorney, Agent, or Firm*—Hedman, Gibson, Costigan & Hoare

[57] ABSTRACT

The invention relates to an arrangement in an offshore platform (1*a*), comprising a deck structure (1) which is supported above the water surface (5) by means of a column structure (14, 2) which in turn rests on and is connected to a foundation (3) on the sea bottom (4). In order to provide a compliant platform structure which is not dependent upon guylines preventing free traffic around and at the platform (1*a*), the column structure (14, 2) comprises at least one hollow column (2), in the cavity (2*a*) of which there is provided at least one tension means (7) which at its first end is connected to the foundation (3), and which at the second end is connected to the column (2). The foundation (3) can be preinstalled at the sea bottom (4), or might constitute a part of the offshore platform (1*a*) such that the latter mounted on the sea bed (4) as a gathered unit.

17 Claims, 14 Drawing Sheets

ARRANGEMENT IN AN OFFSHORE PLATFORM, AND METHOD FOR THE MOUNTING THEREOF

FIELD OF THE INVENTION

The present invention relates to an arrangement in an offshore platform, comprising a deck structure which is supported above the water surface by means of a column structure, which in turn rests on and is connected to a foundation on the sea bottom.

The invention also relates to a method for mounting such an arrangement in an offshore platform.

BACKGROUND OF THE INVENTION

The present invention has been developed in connection with offshore platforms of the type which is permanently located on the sea bottom and is involved in the drilling for hydrocarbons in the sea bed, or for the treatment of such products. The platforms are constructed for installation at a sea depth larger than 300 meters, but this should not be a limitation of the present invention.

Further, the present invention is developed in connection with so-called compliant offshore structures attached permanently to the bottom. Compliant platform structures must be designed in such a manner that they obtain a first fundamental period, which is so much longer (30–50 seconds) than the maximum wave period to which they are subjected, that the dynamic stress influence will become less than the corresponding static condition. Therefore, the platform design must be so "soft" that the period of movement of the platform will not to any degree become the same as the period of the influencing wave, which means that the platform will be compliant to the wave. When being subjected to stresses from ocean currents, waves and wind, the platform might tilt approximately 2–3 degrees at a water depth of 300 meters during a 100-years storm, whereas the corresponding tilt degrees are less at larger depths.

There are previously known platform structures in which the compliant effect is obtained by means of buoyancy tanks, buoyancy tanks combined with guylines and buoyancy tanks combined with various pile solutions etc.

External guylines suffer from the disadvantage of preventing free traffic around the platform and make it difficult for larger crane vessels to dock at and leave the platform.

In connection with compliant piles or telescopic piles one is faced with the problem that even if there is achieved unobstructed traffic around the platform structure, the compliant pile solution will entail a large quantity of piles with associated increased costs and a prolonged building period. The prolonged building period is mainly due to the fact that the piles must be installed after the completion of the trusswork structure.

Compliant platforms based on buoyancy tanks alone will result in unfavourably large structures, which in turn influence both costs and building period.

SUMMARY OF THE INVENTION

The object of the present invention is to provide an arrangement in a compliant tower, giving a simplified structure of the platform itself, at the same time as the production of the arrangement can take place during the same time interval as the building of the platform structure itself. Further, the invention provides for a compliant tower in which is avoided an external system comprising guylines preventing unobstructed traffic to and from the platform.

In an arrangement in an offshore platform of the type as stated in the preamble, these objects are achieved in that the column structure comprises at least one hollow column, in the cavity of which there is provided at least one tensioning means which at its first end is connected to the foundation, and which at its second end is connected in the column.

Preferably, the tensioning means can be constituted by a wire, said wire rendering a flavourable extension due to its spiral-wound form.

It is to be understood that the column or the columns might be included in a concrete structure as well as in a steel structure. The point of attachment for the tensioning means in the hollow column should preferably be in the area below the water surface when the platform is installed at the bottom of the sea.

In this area of the point of attachment or points of attachment there might favourably be provided buoyancy members which might have a predetermined buoyancy capacity relative to the weight of the deck. The buoyancy tanks can thus aid in supporting the vertical load from the platform deck, and they will also during tilting have a stabilizing effect together with the tensioning means or tensioning staybar of the platform columns.

At the upper end the tensioning means can be provided with an attachment means, preferably in the form of a connection pipe which in turn is attached to the inner of the hollow column, for example by cementing.

At the top of the attachment pipe, possibly in an extension of the tensioning means in the area of the attachment pipe, there might appropriately be provided an extension line or extension wire for mounting and clamping the tensioning means during the assembly or mounting of the platform.

The foundation can be constructed in such a manner that one or more of the columns of the platform might rise under the influence of the loading from larger waves, for example a 100-years wave. Possibly, the foundation in the area of the hollow columns might be resilient, said resilient portions following the movement of the column bottom in case this rises under the influence of wave loadings.

In a method for mounting the above mentioned arrangement there is through at least one hollow column pulled at least one tensioning means which at its first end is connected to a platform foundation, and which at its second end is attached internally of the column at the upper part of the platform.

If the foundation of the platform is installed in advance, the tensioning means can at its first end be attach to the foundation in advance, and the second end can be threaded through the columns of the platform while the platform is towed in position towards the foundation, whereafter each tensioning means is prestressed and anchored in the hollow column.

Possibly the tensioning means can be attached to a foundation which prior to the towing of the platform might be attached thereto, such that the platform structure during the installation is piled to the sea bottom as a unit.

Further features and advantages in connection with the present invention will appear from the following description with reference to the attached drawings illustrating embodiments of the invention.

DETAILED DESCRIPTION OF THE PREFERRED EMBODIMENTS

Figure 1:
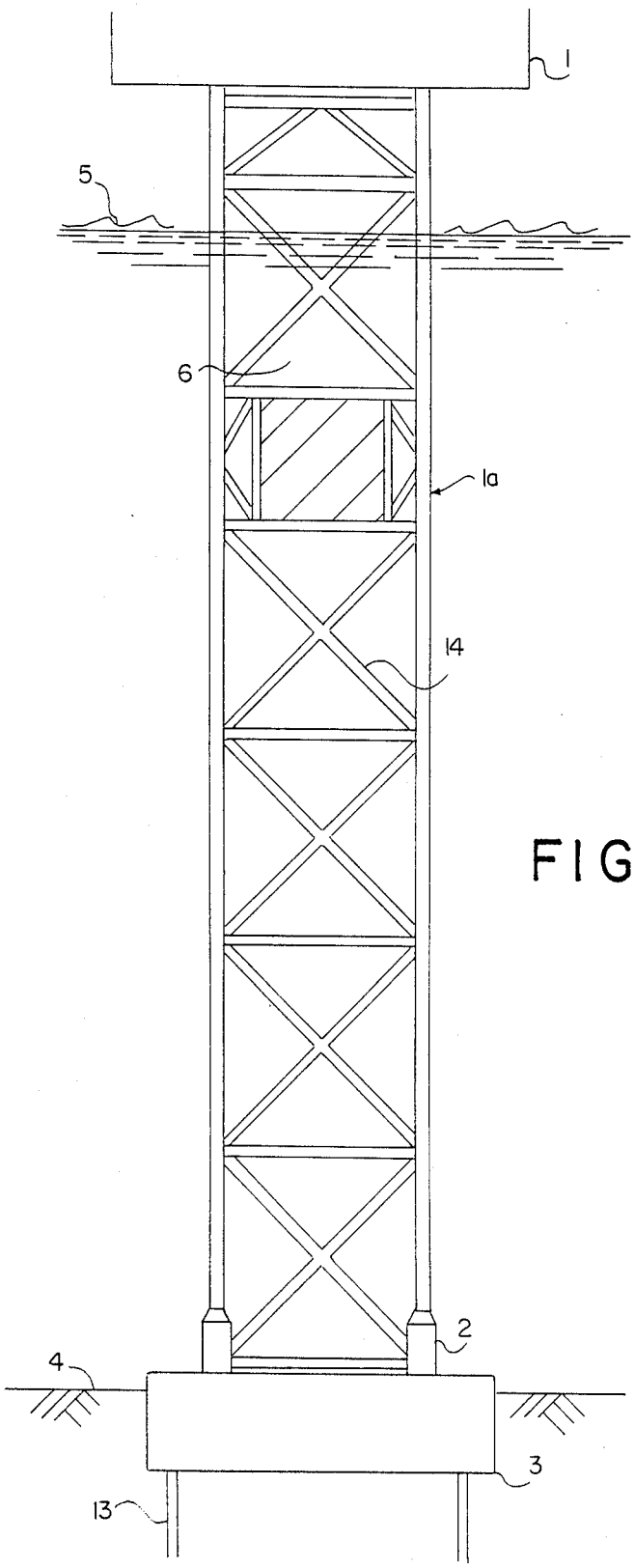
FIG. 1 is a side view of a platform structure comprising an arrangement according to the present invention.

In FIGS. 1–4 reference numeral 1*a* designates an offshore platform comprising a deck structure 1 for drilling for oil/gas in the bottom, or for the production and treatment of such products.

The deck structure 1 is carried by a column structure comprising a plurality of columns 2 which are mounted on a foundation 3, which in turn rests on the sea bottom 4 when the platform structure 1*a* is finally installed.

The foundation 3 can for example be installed in advance at the sea bottom, such that it maybe freely lowered into the recesses 3*a* at the upper side of the foundation.

In the area below the water surface 5 there are provided one or more buoyancy tanks 6 rendering a stabilizing function to the platform structure, and at the same time aiding in resisting vertical forces.

Figures 2A, 2B:
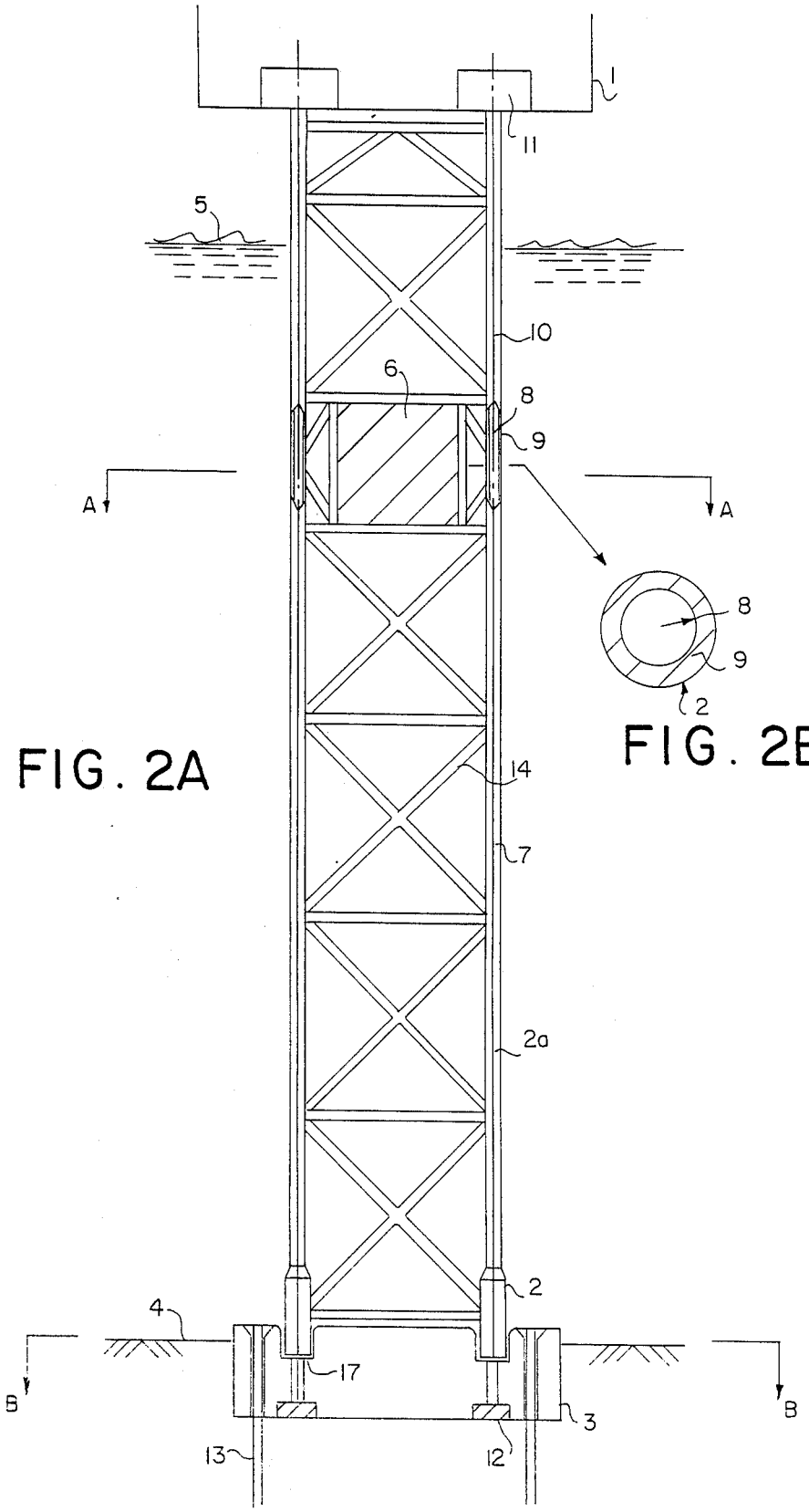
FIG. 2A is a cross-sectional view through the platform structure shown in FIG. 1.
FIG. 2B is a cross-sectional view taken along the line A—A of FIG. 2A.

As is especially apparent from FIG. 2, the platform structure comprises columns 2 which are hollow, and in the cavities 2*a* of the coluns there are provided one or more tensioning means 7 which at their lower end is connected to the foundation 3, and which at their upper end is connected to a point in the upper part of the platform. Appropriately, the upper part of the tensioning means 7 is an attachment pipe 8 which by means of an attachment means 9, for example concrete, binds the outer surface of the attachment pipe 8 to the inner wall of the column 2.

At the top of the attachment pipe 8 there is provided a line or a cable 10 which serves for the prestressing of the tensioning means 7 before the moulding thereof to the columns 2 of the platform, and the line 10 is in this connection at its upper end connected to a jack device 11 serving for pretensioning and possible mounting of the tensioning means 7.

As already mentioned, the lower end of the tensioning means 7 is connected to the foundation 3, and an attachment means can for example be of the type illustrated in FIG. 2 and designated by 12.

Figure 4:
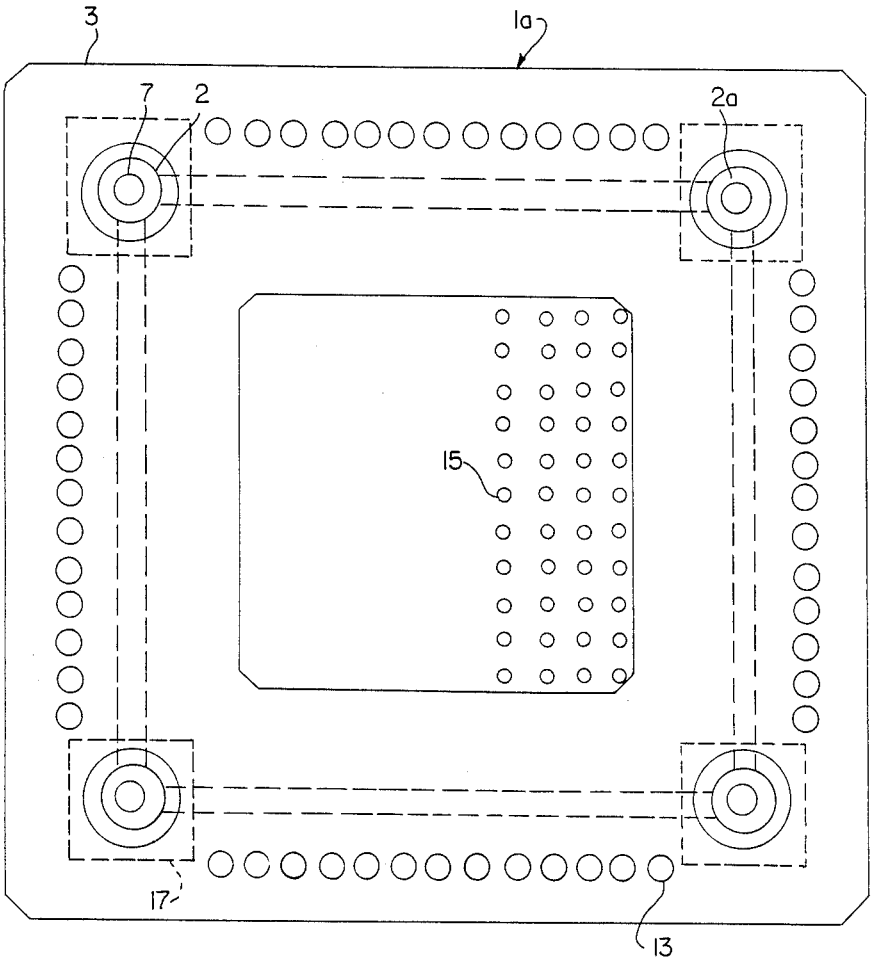
FIG. 4 is a cross-sectional view taken along the line B—B in FIG. 2.

The foundation 3 is in this respect attached to the sea bottom 4 by means of stabilizing piles 13, as clearly shown in FIGS. 2 and 4.

Figure 3:
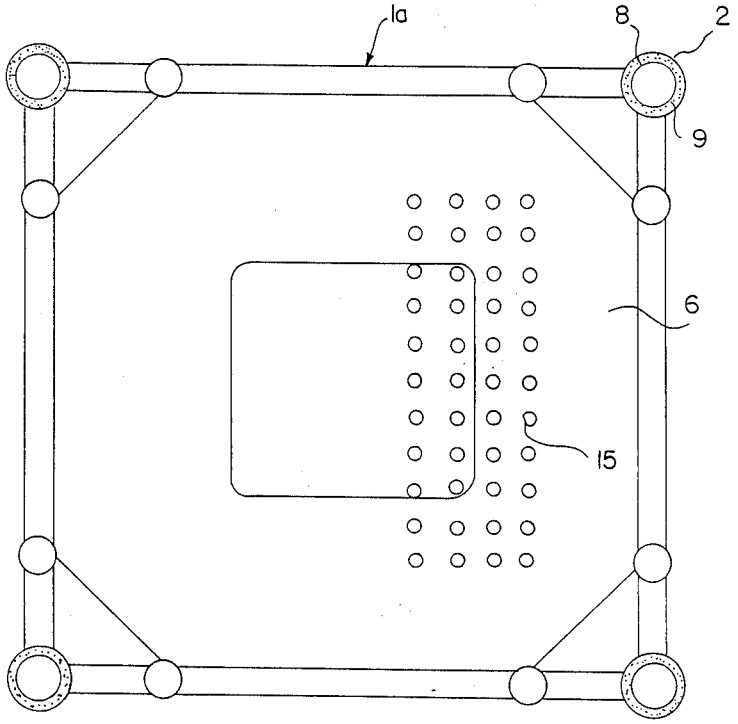
FIG. 3 is a cross-sectional view taken along the line A—A in FIG. 2.

The steel structure 14 of the platform thus extends between the columns 2 from the foundation 3 and above the water surface 5, where it carries the deck structure 1. In the steel structure 14 there is provided space for a drilling pipe 15 as shown in FIGS. 3 and 4 serving for the drilling for hydrocarbons in the ground. In the recesses 3*a* in which the lower ends of the columns 2 are located, there might be provided an anchoring plate 17, or a support of different quality, as discussed below.

It is to be understood that the tensioning means 7 can be constituted by a wire, said wire rendering a good flexibility due to its spiral-wound form. However, other tensioning means meeting the structural requirements can be used as well.

In the embodiment illustrated in FIGS. 1–4, there is provided one tensioning means 7 in each column 2, but it is to be understood that the number and the location of the tensioning means in each column can be varied all according to the structural conditions.

Since the tensioning means 7 at its first end is connected to the platform foundation 3 and at its second end is connected to a point of the attachment pipe 8 in the upper part of the platform, and since the tensioning means 7 prior to its attachment has be prestressed by means of the jack device 11 at the top of each column 2, the finished mounted offshore platform 1*a* will be attached to the foundation 3 in a resilient or compliant manner, because the tensioning means 7 have been given a satisfactory elasticity for resisting bending moments appearing during tilting of the platform 1*a*. The correct elastic extension in the tensioning means during tilting of the platform, is achieved by calculating necessary length of the tensioning means 7 in dependence of the elasticity of the tensioning means.

It is also to be understood that the anchoring of the upper ends of the tensioning means 7 in the hollow columns 2 can be constituted by any mechanical type in addition to or as an alternative to the solution of moulding discussed above. If there is used and attachment pipe 8 which is anchored by means of concrete 9, the length of the pipe 8 can be calculated on basis of expected stress in the tensioning means 7 and the shear capacity of the cured attachment. The length of the tension means 7 can thus be adapted to the calculated necessary length, by attaching the pipe 8 at a corresponding level in the column 2.

It should further be understood that the size and location of the bouyancy tanks 6 must be adapted to the calculated values depending on for example the deck weight, ambient forces and water depth.

It is also to be understood that one or more hollow columns might be included in a concrete structure.

Figure 5:
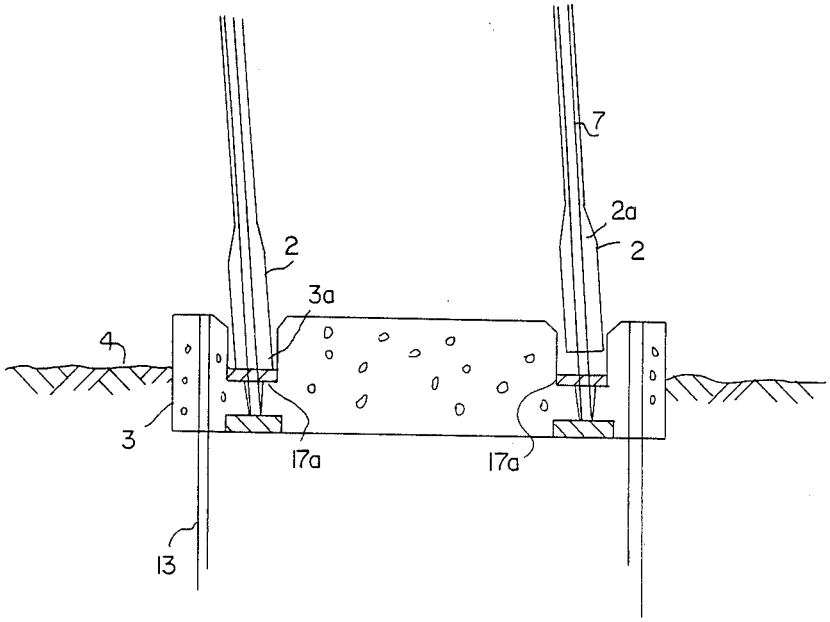
FIG. 5 is a vertical cross-sectional view through the foundation and the lower part of the column structure illustrated in a partly raised condition.

Since compliant mounting of an offshore platform 1*a* is contemplated, the columns 2 of the platform should be able to rise at the one side of the foundation 3 under the influence of wave loads from larger waves, for example a 100-years wave. Such a situation is diagrammatically illustrated in FIG. 5. In this connection the bottom of each column 2 is located in a corresponding recess 3*a* having a firm support 17*a*.

Figure 6:
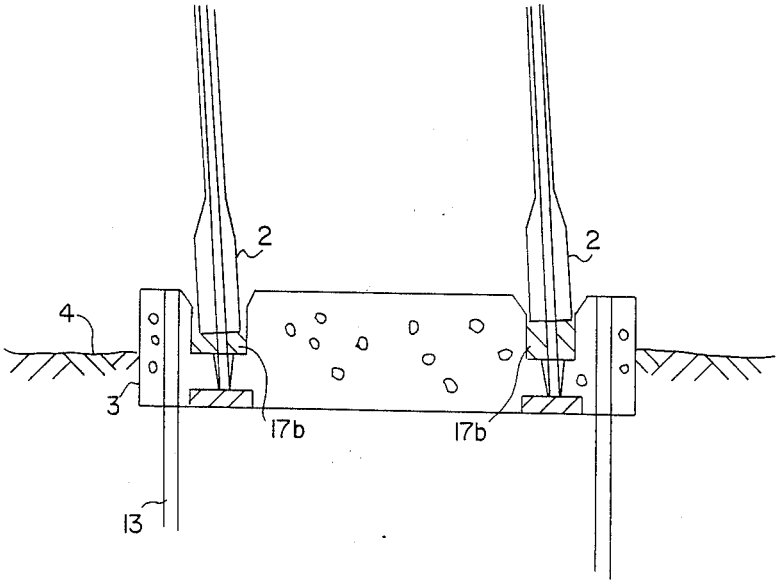
FIG. 6 is a cross-sectional view similar to FIG. 5, but including resilient foundation members.
Figure 7:
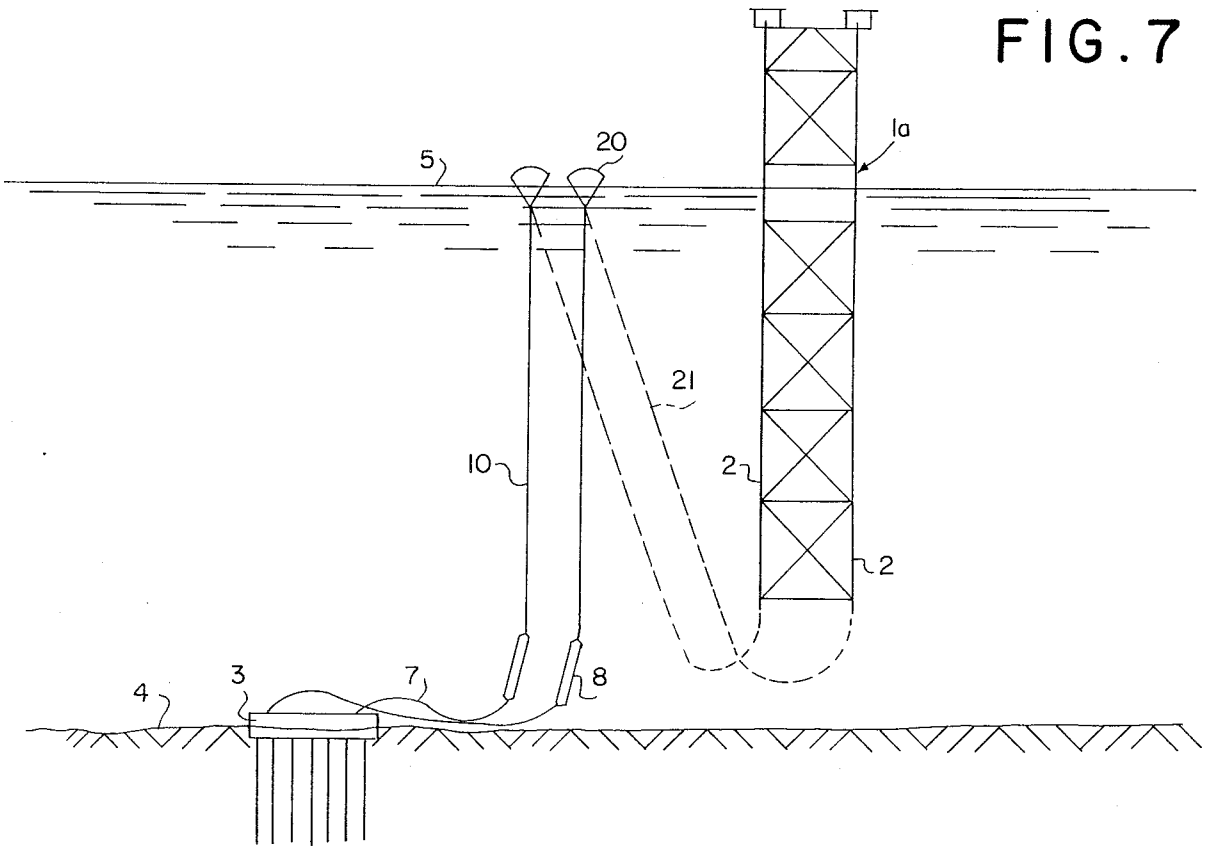
FIGS. 7–10 illustrate various steps for mounting the arrangement according to the present invention.
Figure 8:
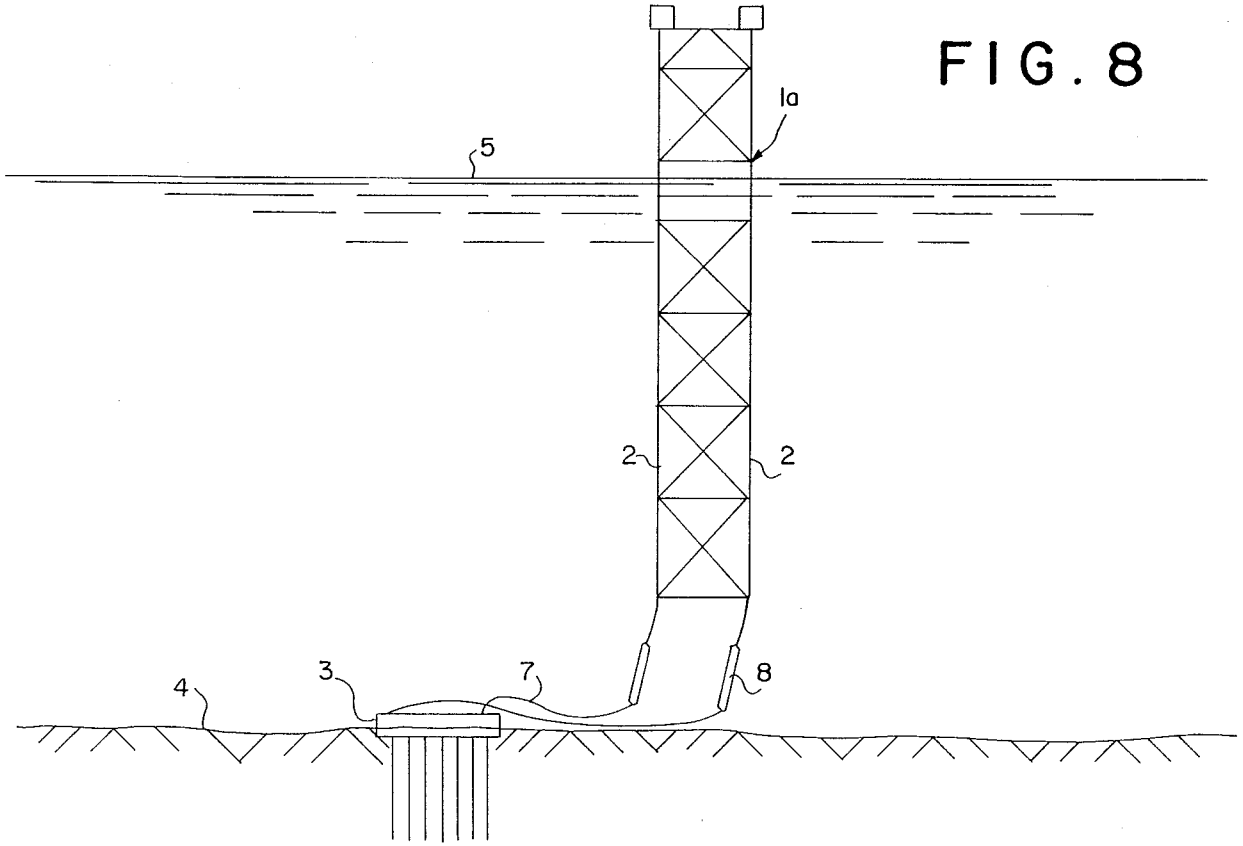
Figure 9:
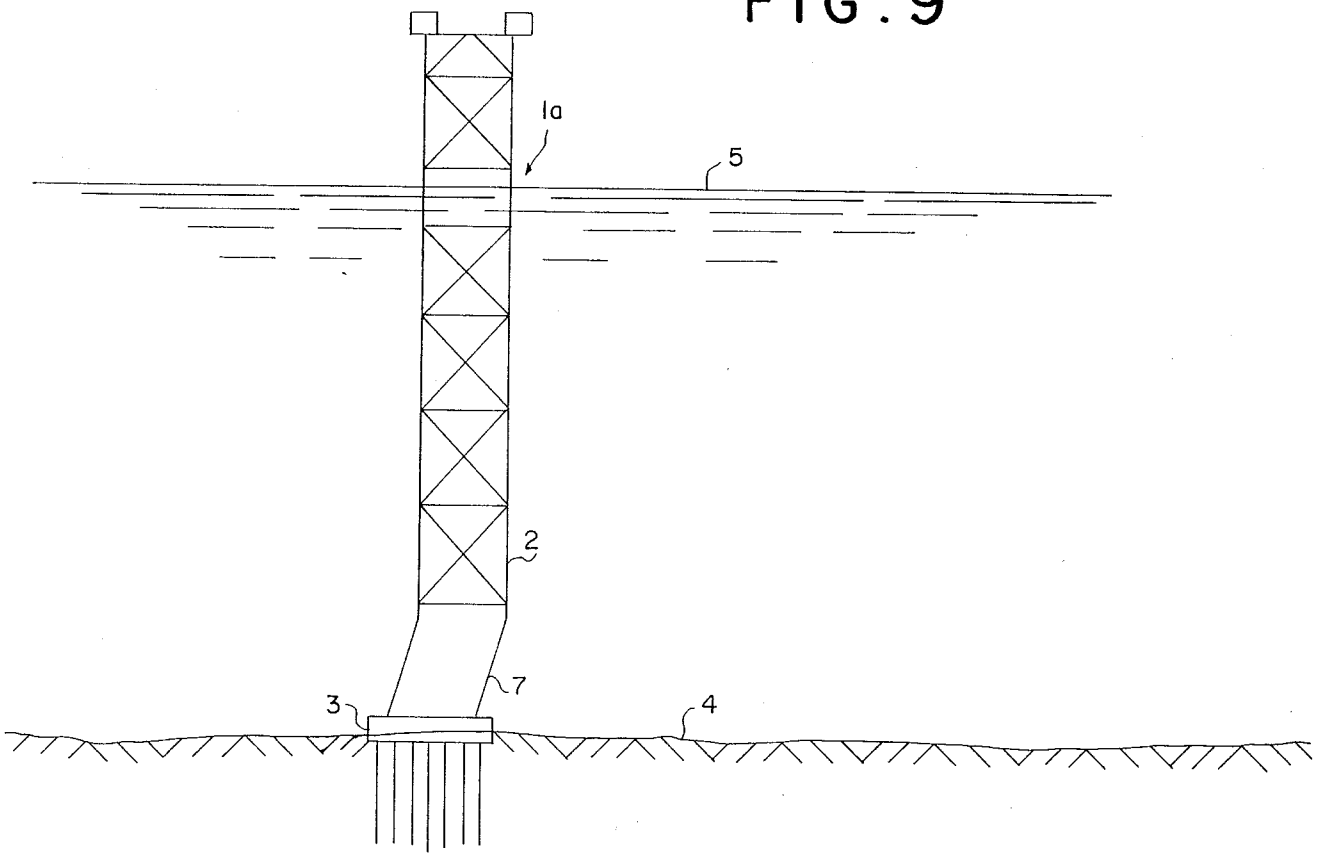
Figure 10:
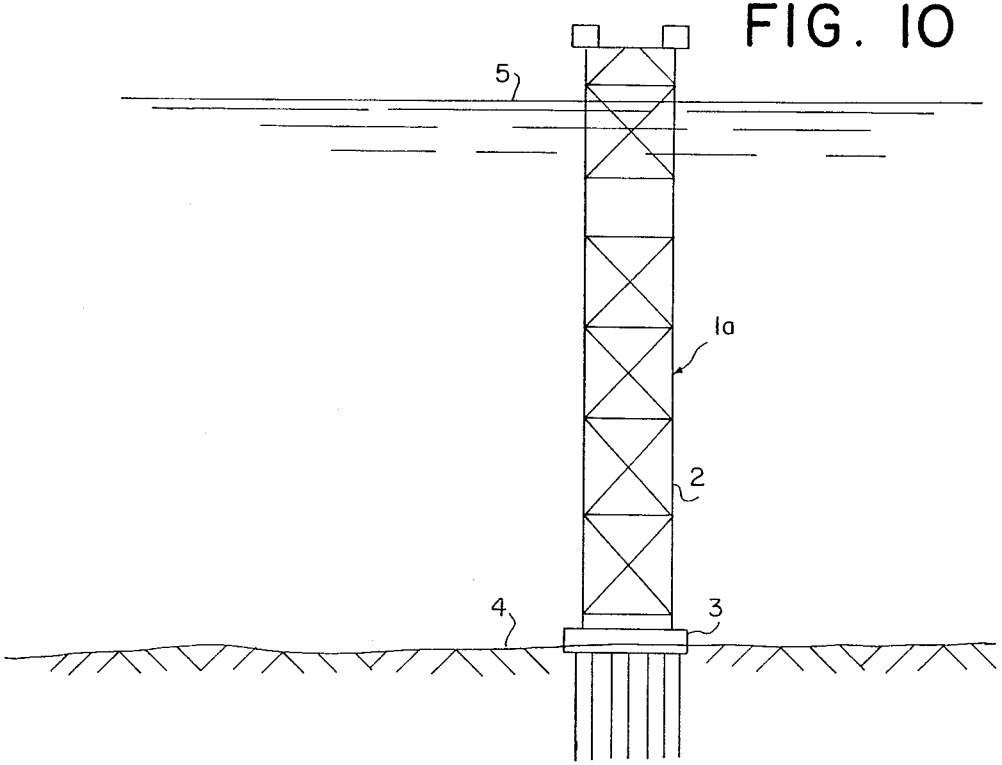

The columns 2 of the platform can possibly rest member 17*b* made of steel or an elastic material, as this is indicated in FIG. 6. If an elastic material is to be used for the member 17*b*, there should be contact between the foot of the column 2 and the foundation 3, also during the influence of a 100-years wave.

In FIGS. 7–10 there are illustrated various steps in the method for mounting and installing of an offshore platform according to the present invention.

The installation can be effected by placing the foundation 3 at the bottom 4 as a first step, while the tensioning means 7 at their first ends are attached to the foundation 3, whereas said tensioning means 7 at their second ends are provided with attachment pipes 8 which in turn are extended by means of lines or cables 10 attached to floating bodies 20 at the sea surface 5.

The tensioning means 7 are laid out on the sea bottom 4 in a special pattern for thereafter being pulled up in a respective column 2 of the platform structure 1*a*, the platform 1*a* at the same time floating verticaly in the water and being towed in correct position relative to the foundation and the tensioning means 7. Auxiliary cables 21 are used for pulling the lines 10, the attachment pipes 8 and the tensioning means 7 themselves into the columns 2 of the platform, as this appears at the various stages illustrated in FIGS. 7, 8, 9 and 10.

Figure 11:
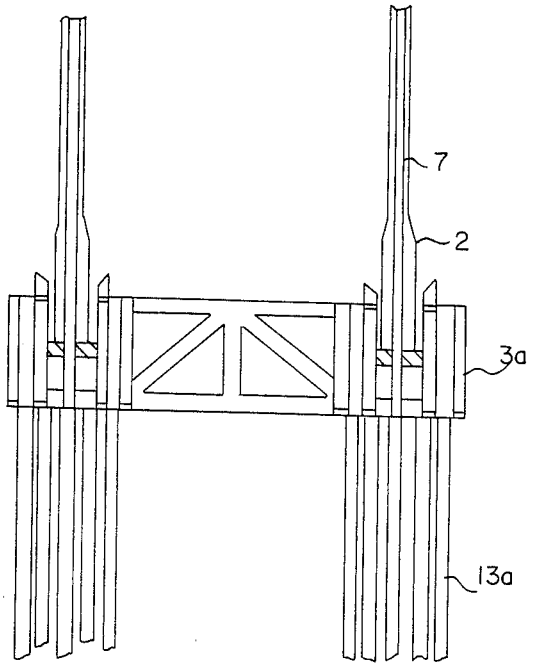
FIG. 11 is a vertical cross-sectional view through the lower part of an alternative column structure and associated foundation.
Figure 12:
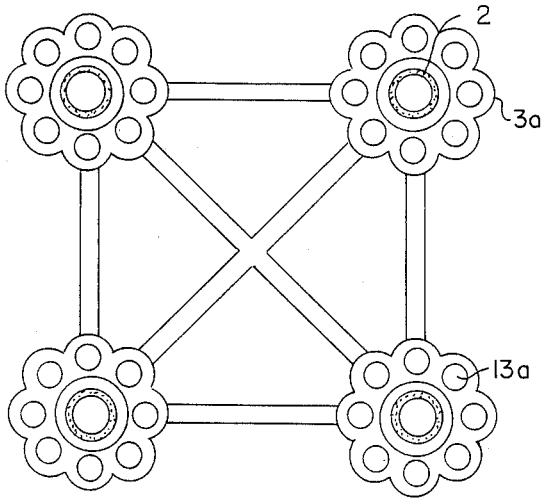
FIG. 12 is a horizontal cross-sectional view through the structure according to FIG. 11.

In FIGS. 11 and 12 there is illustrated an alternative steel foundation 3*a* of a lighter type. This foundation 3*a* can primarily be premounted by means of piles 13*a* in the same manner as the foundation 3 discussed in connection with FIGS. 7–10.

Figure 13:
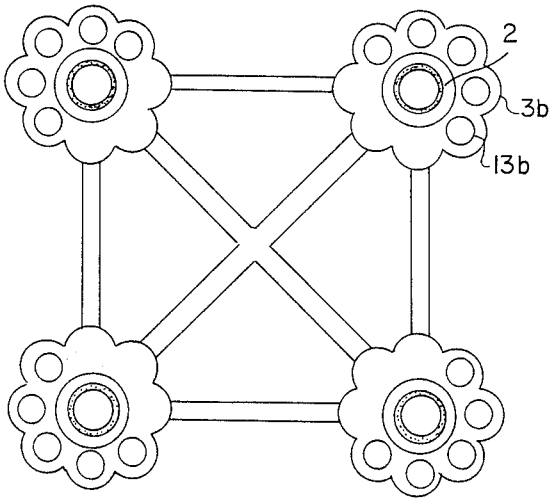
FIG. 13 is a horizontal cross-sectional view through the bottom area of a platform structure having a foundation requiring fewer piles for the attachment to the sea bottom.

When dealing with smaller deck weights and water depths the number of piles 13*b* can be reduced to such a degree that the foundation 3*b*, as this appears from FIG. 13, can be installed attached to the platform, which means that the platform structure is piled to the sea bottom as a unit comprising the foundation.

Figure 14:
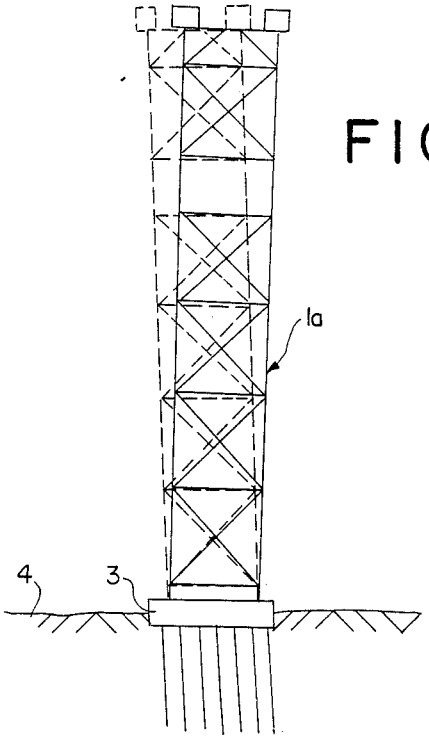
FIG. 14 illustrates diagrammatically an offshore platform in a tilted position under the influence of wave forces.

In FIG. 14 it is illustrated how the offshore platform 1*a* will be influenced by wave movements (exaggerated), the columns at the one side being lifted from the foundation 3.

I claim:

1. An arrangement in an offshore structure (1*a*) comprising:
   (a) a platform (1) having a deck above the surface of the water;
   (b) a foundation (3) affixed to the sea bottom (4) and having at least one recess therein;
   (c) a column structure (14, 2) movably attached at one end to the foundation and rigidly attached to the platform at an opposed end, said column structure comprising at least one hollow column insertable into the recess of the foundation and movable therein and having a longitudinally extending cavity (2*a*) therein; and
   (d) tensioning means within said longitudinally extending cavity and rigidly attached at one end to the foundation and at an opposed end to the platform, said tensioning means adapted to maintain a substantially linear connection between the foundation and the platform, whereby when said platform moves in response to natural forces said hollow column moves within said recesses in a manner sufficient to maintain said linear connection.

2. The arrangement of claim 1 wherein the tensioning means (7) comprises a wire means.

3. The arrangement of claim 1 wherein said foundation is made of concrete.

4. The arrangement of claim 1 wherein the tensioning means is attached to the platform below the water surface.

5. The arrangement of claim 1 wherein the platform further comprises buoyancy means (6) mounted to the column structure and below the water surface and which is adapted to stabilize the platform.

6. The arrangement of claim 5 wherein the buoyancy means comprises at least one buoyancy tank.

7. The arrangement of claim 5 wherein the tensioning means (7) is attached to the platform at the buoyancy means.

8. The arrangement of claim 1 wherein the tensioning means further comprises at its upper end an attachment means (8) fixedly attached at one end to the inner surface of the hollow column and at an opposed end to the platform.

9. The arrangement of claim 8 wherein the attachment means comprises a pipe means.

10. The arrangement of claim 8 wherein the attachment means is attached to the inner surface of the hollow column with cured concrete.

11. The arrangement of claim 9 further comprising a second wire means attached to the top of the pipe means, said second wire means adapted to mount and exert pretension on the tensioning means.

12. The arrangement of claim 1 wherein said recess or said hollow column contains resilient means for facilitating upward movement of the hollow column in the recess.

13. The arrangement of claim 12 wherein the resilient means is operatively secured to the recess.

14. A method of assembling an arrangement in an offshore structure (1*a*), said structure comprising a platform (1) having a deck above the surface of the water; a foundation (3) affixed to the sea bottom (4) and having at least one recess therein; a column structure (14, 2) comprising at least one hollow column having a longitudinally extending cavity (2*a*) therein; and tensioning mean (7) within the longitudinally extending cavity and rigidly attached at one end to the foundation and at an opposed end to the platform, said method comprising:
   (a) affixing the tensioning means to the foundation;
   (b) threading the tensioning means through the cavity of the hollow column while moving the platform towards the operable position above the foundation;
   (c) inserting the hollow columns into the recess of the foundation; and
   (d) attaching the tensioning means to the platform, whereby the tensioning means is tensioned.

15. The method of claim 14 comprising attaching the tensioning means to the platform, moving the platform in the operable position above the foundation whereby the platform during installation is piled to the sea bottom (4) as a unit.

16. The method of claim 14 further comprising providing said recess or said hollow column with resilient means for facilitating movement of the column in the recess.

17. The method of claim 16 comprising providing resilient means in said recess.

* * * * *